10/22/85 OR 4,548,292

United States Patent [19]

Noxon

[11] Patent Number: 4,548,292

[45] Date of Patent: Oct. 22, 1985

[54] REFLECTIVE ACOUSTICAL DAMPING DEVICE FOR ROOMS

[76] Inventor: Arthur M. Noxon, 437 Lawrence, Eugene, Oreg. 97401

[21] Appl. No.: 656,677

[22] Filed: Oct. 1, 1984

[51] Int. Cl.[4] ..... E04B 1/82

[52] U.S. Cl. ..... 181/295; 181/286; 181/290

[58] Field of Search ..... 181/286, 287, 295, 290

[56] References Cited

U.S. PATENT DOCUMENTS

| | | | |
|---|---|---|---|
| 2,160,638 | 5/1939 | Bedell et al. | 181/295 X |
| 2,502,020 | 3/1950 | Olson | 181/295 |
| 2,706,530 | 4/1955 | Abrams | 181/295 |
| 4,319,661 | 3/1982 | Proudfoot | 181/295 |
| 4,362,222 | 12/1982 | Hellstrom | 181/295 X |

*Primary Examiner*—Benjamin R. Fuller
*Attorney, Agent, or Firm*—James D. Givnan, Jr.

[57] ABSTRACT

An acoustical device for damping and absorption of certain frequencies in a room and including a surface which functions as a low pass filter to maintain low frequency absorptive properties without reducing the acoustical brightness of the room. The device may be embodied as a piece of free standing room furniture. A capped tube of the device defines an internal ambient air chamber. Exteriorly of the tube is a perforate sound reflective member. The perforation size and spacing function as a mechanical low pass cross-over system. A cross-over option is presented to include an imperforate limp mass sheet covering at least partially the absorbent tube surface.

10 Claims, 7 Drawing Figures

REFLECTIVE ACOUSTICAL DAMPING DEVICE FOR ROOMS

BACKGROUND OF THE INVENTION

This invention concerns noise control devices for a room that increases the decay rate of room resonances without excessively dampening the acoustical brightness of the room.

U.S. Pat. No. 4,362,222 to Hellstrom discloses a dampener unit for corner placement. The benefits from noise control methods so placed are outlined in the patent noting particularly low frequency absorbtion without the use of Helmholtz resonators. An absorbive panel extends diagonally across a room intersection of a ceiling and wall and establishes a volume with a flow resistive surface that faces pressure fluctuations resulting from reflecting sound waves.

Diffraction type sound absorbers are found in many variations. Some are filled with fiberglass while others have a hollow interior with a fiberglass blanket skin. Some sound dampeners incorporate Helmholtz resonators to enhance low frequency absorption with maximum sound absorption their common goal. U.S. Pat. No. 2,160,638 by Bedell discloses a fiber packed tube with a perforate metal skin. U.S. Pat. No. 2,502,020 shows a perforate metal skin with a hollow interior and a fiber liner immediately inside the skin. U.S. Pat. No. 2,706,530 shows a rectangular suspended absorbant with openings to introduce the resonator aspect. U.S. Pat. No. 4,319,661 shows a unit which places discrete Helmholtz resonators at the ends of the Bedell type tube, for low frequency absorbtion of around 125 Hz.

The extensive use presently of acoustical tiles in ceilings and upper wall surfaces serves to control the decay rates of higher frequencies above 500 Hz. In order to absorb energy in the low frequency range, a large amount of absorbant material is often used and undesirably the acoustical brightness of a room is thereby diminished. The modern room, with its higher frequency decay rate controlled by standard architectural acoustical wall and ceiling treatments still however has a major problem in the control of room resonance and lower frequency decay rates.

Important objects of the present invention include the provision of an acoustical device which serves to dampen low frequency sound waves while reflecting higher frequencies so as to enhance room acoustics; the provision of an acoustical device which is adapted for placement in a room tri-corner for optimum performance; the provision of a sound dampener of a free standing type having nonuniform dampening and reflective qualities.

DETAILED DESCRIPTION OF PREFERRED EMBODIMENTS

Figure 1:
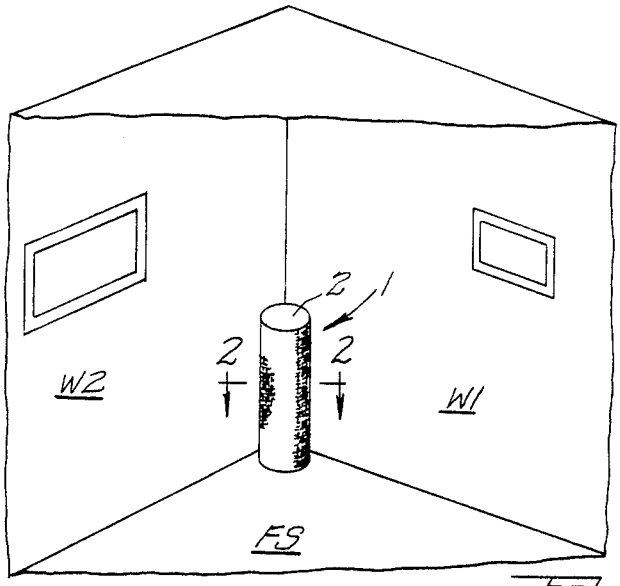
FIG. 1 is a perspective view of the present damping device in place in a room.
Figure 2:
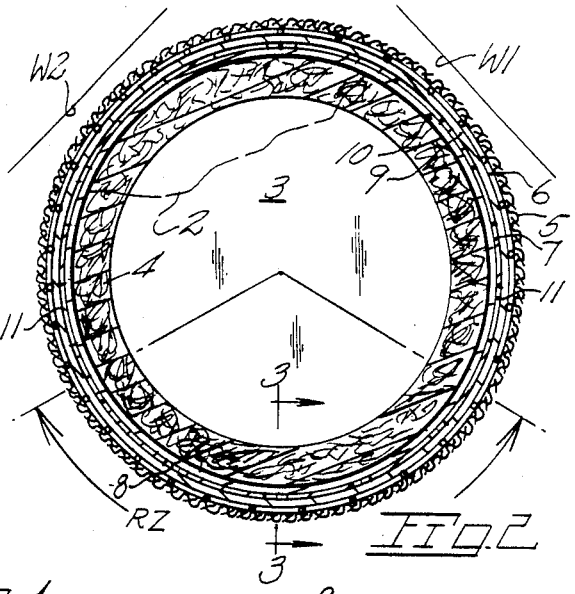
FIG. 2 is a horizontal sectional view taken along line 2—2 of FIG. 1.
Figure 4:
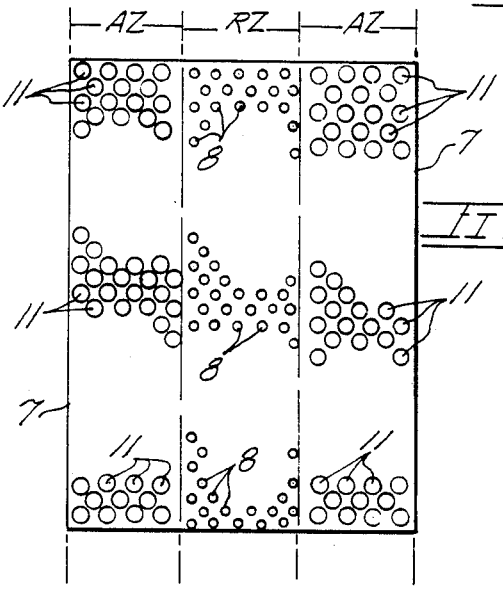
FIG. 4 is an elevational view of a perforate reflector removed from the present device and configured to planar shape for purposes of illustration.
Figure 3:
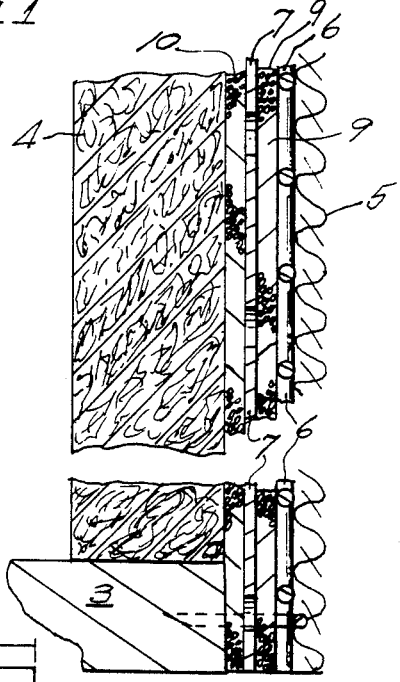
FIG. 3 is a vertical sectional view taken along line 3—3 of FIG. 2.

With continuing reference to the drawing, the reference numeral 1 indicates generally the present device in place within a tri-corner of a room formed by the intersection of two walls W1-W2 and a floor surface FS.

The device is of elongate configuration and includes top nd bottom closures 2 and 3 for a sound absorbent member shown as a fibrous tube 4 which may be of fiberglass. A cover at 5 may be of fabric compatible with room decor. Interiorly of cover 5 is a reinforcing member 6 shown as being of open wire mesh screen suitably secured at its top and bottom ends by suitable means to the end closures 2 and 3. A preferred form of sound wave reflector at 7 is a sheet of rigid material having a first series of spaced apart perforations. The size and spacing of perforations 8 are calculated, as later elaborated upon, to permit the passage of the low frequency portion of each sound wave while the outer surface of reflector 7 functions to reflect that portion of the waves above 500 Hz. Contact of the reflector 7 with adjacent rigid structure of the device is prevented by coextensive porous sheets 9 and 10 which may be open cell foam material.

The preferred form of reflector at 7 defines, as earlier noted, a first series of perforations at 8 on about one third of the reflector area to constitute a sound reflective zone RZ. A second series of perforations at 11 are on the remaining two thirds or so of reflector 7 which constitute sound absorbent zones at AZ. When operationally disposed in cylindrical device the zone RZ may occupy a 120 degree arc or expanse while zones AZ comprise the remaining expanse of 240 degrees. It is to be understood that the zones RZ and AZ may vary in their arcuate dimension with zone RZ having a maximum arcuate dimension of approximately 180 degrees to avoid undesirable sound wave reflection toward proximate walls W1-W2.

Optimum placement of the device in a room results in a bisector of the corner formed by walls W1-W2 bisecting the zone RZ with zones AZ proximate the two wall surfaces.

Reflector 7 may be formed from an 18 ga. aluminum sheet. Perforations 8 may be quarter inch holes on one and three quarter inch centers to provide a cumulative open area in zone RZ of about 2% resulting in a cross-over frequency of 320 Hz using the following formula: fx (cross-over frequency)+40 p/d with p=to the percent ratio of open area to closed area in zone RZ and with d=hole diameter in inches. The perforations at 11 are as large as sheet integrity will permit.

Figure 5:
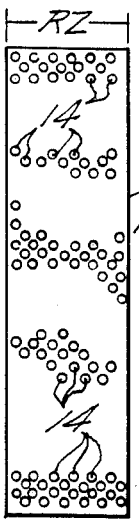
FIG. 5 is a view similar to FIG. 4 but showing a modified perforate reflector.

In FIG. 5 a modified reflector is shown at 12 wherein only a zone RZ is provided for disposition in the device as noted in the description of the analogous zone in the above described reflector. The hole criteria of perforations 14 in zone RZ is also as stated above.

Figure 6:
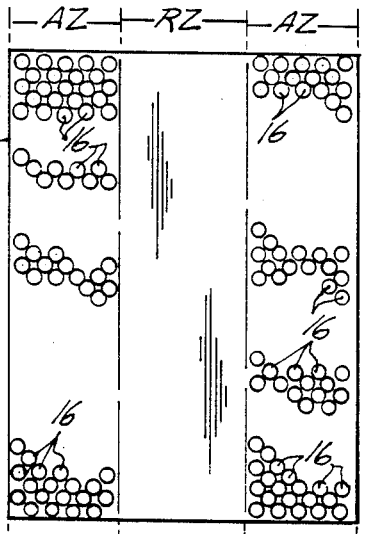
FIG. 6 is an elevational view of a limp mass reflector.

With attention to FIG. 6 a limp mass reflector is shown formed from a pliable sheet 15 such as one of vinyl of a size to fully overlie foam covered tube 4. The sheet has a reflective zone at RZ and absorbent zones AZ with the zone orientation with respect to room walls W1-W2 being as noted with the first described reflector. Zone RZ is imperforate while zones AZ are perforate with holes at 16 of a diameter limited only by sheet integrity.

Figure 7:
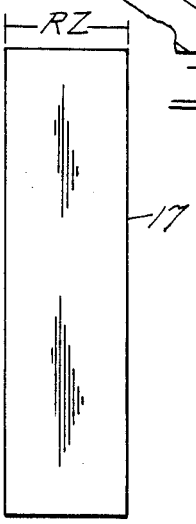
FIG. 7 is an elevational view of a modified limp mass reflector.

In FIG. 7 a further form of a limp mass reflector at 17 is shown wherein only a reflective zone RZ is utilized and the perforate zones AZ dispensed with. Zone RZ of reflector 17 would be located relative intersecting wall surfaces as above described.

The limp mass reflector may utilize a vinyl sheet rated at 2 ozs. per square foot.

A cross-over frequency may be determined in the following formula: fx (cross-over frequency)=(720/w) with w=to the per square foot weight in ounces of the limp mass sheet. A cross-over frequency for the limp mass sheet accordingly would be 360 Hz for a sheet weighing 2 ozs. per square foot.

The present device is best utilized when installed in a room tri-corner to take advantage of room resonance while promoting scattering of high frequencies. The device may be located midway between adjacent tri-corners with some reduction in effectiveness. Additionally, the device may be used in various lengths and in multiples by stacking of the devices. If desired, two devices may utilize a common end closure to provide a device of extended length.

While I have shown but a few embodiments of the invention it will be apparent to those skilled in the art that the invention may be embodied still otherwise without departing from the spirit and scope of the invention.

Having thus described the invention, what is desired to be secured in Letters Patent is:

1. A sound dampening device for use within a room area, said device comprising, a continuous sound absorbent member of elongate tubular shape, a closure means in place on the opposite ends of said absorbent member to define therewith a chamber, porous sheet material in place about said sound absorbent member, and a reflector overlying said porous sheet, said reflector having a reflective zone extending only partially about said absorbent member to reflect wave frequences approximately 300 Hz and above with the absorbent member serving to dampen lower frequencies.

2. The device claimed in claim 1 wherein said reflector is formed from rigid material.

3. The device claimed in claim 2 wherein said reflector has both sound wave reflective and absorbent zones.

4. The device claimed in claim 3 wherein said zones are perforate.

5. The device claimed in claim 4 wherein the reflective zone defines in cumulative open area of about 2 percent.

6. The device claimed in claim 5 wherein said reflective zone is of an expanse no greater than one half the perimeter of the device.

7. The device claimed in claim 1 wherein said reflector is a limp mass sheet.

8. The device claimed in claim 7 wherein said reflector has both a reflective zone and an absorbent zone.

9. The device claimed in claim 8 wherein said reflective zone is imperforate.

10. The device claimed in claim 9 wherein said reflective zone is of an expanse no greater than one half of the perimeter of the device.

* * * * *